US007438207B2

(12) United States Patent
Wu et al.

(10) Patent No.: US 7,438,207 B2
(45) Date of Patent: Oct. 21, 2008

(54) DUST-REMOVING STRUCTURE OF A NAILER

(75) Inventors: Jian Rung Wu, Taichung (TW); Min Hsu Tsang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/760,753

(22) Filed: Jun. 9, 2007

(65) Prior Publication Data

US 2008/0105729 A1 May 8, 2008

(30) Foreign Application Priority Data

Nov. 3, 2006 (TW) ..... 95140888 A

(51) Int. Cl.
*B25C 1/04* (2006.01)

(52) U.S. Cl. ..... 227/130

(58) Field of Classification Search ..... 227/130, 227/156, 112

See application file for complete search history.

(56) References Cited

U.S. PATENT DOCUMENTS 3,685,396 A * 8/1972 Obergfell ..... 91/356
3,788,195 A * 1/1974 Lange ..... 91/457
3,850,079 A * 11/1974 Fehrs ..... 91/308
4,319,705 A * 3/1982 Geist et al. ..... 227/120
4,384,668 A * 5/1983 Tutomu et al. ..... 227/8
4,401,251 A * 8/1983 Nikolich ..... 227/130
4,784,308 A * 11/1988 Novak et al. ..... 227/130
5,259,465 A * 11/1993 Mukoyama ..... 173/168
5,725,142 A * 3/1998 Hamada ..... 227/130
5,878,936 A * 3/1999 Adachi et al. ..... 227/130
5,927,584 A * 7/1999 Akiba ..... 227/130
6,196,331 B1 * 3/2001 Naito et al. ..... 173/169
6,783,050 B2 * 8/2004 Ishizawa et al. ..... 227/130
7,322,505 B2 * 1/2008 Ishizawa et al. ..... 227/130
2001/0004084 A1 * 6/2001 Hirai et al. ..... 227/130
2004/0026477 A1 * 2/2004 Ishizawa et al. ..... 227/130

* cited by examiner

*Primary Examiner*—Brian D Nash
(74) *Attorney, Agent, or Firm*—Egbert Law Offices

(57) ABSTRACT

The present invention provides a dust-removing structure for the nailer. The dust-removing structure, located at a preset position of the nailer, includes a release valve lever with a control unit for drive. The control unit is a lever-type control unit, having a pivot point, a drive portion and a laterally extended control portion. The drive portion is coupled with the release valve lever, and the control portion swings around the pivot point. An actuating arm is implemented through the control portion and the swinging behavior, making it possible to more easily operate using a single-hand. When the dust-removing structure is assembled at different heights with different shapes of nailers, the operator is only required to replace the lever-type control unit with different lengths to obtain the optimum pressing location.

5 Claims, 7 Drawing Sheets

DUST-REMOVING STRUCTURE OF A NAILER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a nailer or nail gun, and more particularly to an innovative nailer with a dust-removing structure.

2. Description of Related Art Including Information Disclosed Under 37 CFR 1.97 and 37 CFR 1.98.

To improve the performance of existing nailers, an innovative nailer with a dust-removing structure has been developed. The dust-removing structure is commonly located at a preset position on the nailer body for easy operation. This dust-removing structure blows out air towards a predefined direction, thus removing dust from the objects.

In view of the structural patterns of commercially available prior art dust-removing structures of nailers, the manual control portion is often designed as a pushbutton, as shown in FIG. 1 from Taiwan Patent Application No. 92114547, entitled "Nailer with dust-remover". The air blowing is activated to remove dust by manually pressing the pushbutton 11 of the dust-removing structure 10.

The following shortcomings are found for this typical structure in application.

Referring to FIG. 1, since the nailer handle 12 is held by the palm and four fingers, only the thumb is able to control the pushbutton 11 of the dust-removing structure 10. Since a spring is often assembled within said pushbutton 11 to support it elastically, and since the pushbutton 11 is located often at a top of the nailer and away from the nailer handle 12, it is difficult for the operator to raise the thumb to the pushbutton. Thus, the force applied by the thumb to the pushbutton 11 is very weak. The inverse spring force also makes it difficult to manipulate the nailer's dust-removing structure with a single hand. In such a case, the goal of operating the dust-removing structure by a single hand cannot be achieved in practice.

The other problem is that a variety of nailers differ from each other with respect to appearance and specifications. As for the pushbutton 11 of said dust-removing structure, the possibility of single-hand operation is reduced if it is positioned far away from the nailer handle 12. Even if the pushbutton is located in a higher location, the operation will remain inconvenient since the vertical spacing cannot be changed, for example, when the pushbutton of the dust-removing structure is parallel with the nailer handle. In such a case, the dust-removing structure of a typical nailer has poor applicability for different nailers, resulting in higher assembly cost.

Additionally, another prior art dust-removing structure of a nailer has been developed. Referring to FIG. 2 from Taiwan Patent Application No. 94200404, entitled "Nailer with dust-removal function", a cylinder 14 is assembled at one side of the nailer 13, and a piston rod 15 is inserted into the cylinder 14. One end of the piston rod 15 protruding from the cylinder is linked to a switch 16. The operator may pull the switch 16 to drive the piston rod 15, so the inner end 17 of the piston rod 15 is disengaged from a retaining groove 18, allowing internal air pressure to be blown out from the jet hole 19. However, since the operation of the dust-removing structure is finished by pulling the switch 16, the application of force from the fingers will lead to inconvenient operation by single hand.

Thus, to overcome the aforementioned problems of the prior art, it would be an advancement in the art to provide an improved structure that can significantly improve efficacy.

To this end, the inventor has provided the present invention of practicability after deliberate design and evaluation based on years of experience in the production, development and design of related products.

BRIEF SUMMARY OF THE INVENTION

Based on the unique present invention, the lever-type control unit 50 comprises a pivot point 51, a drive portion 52 and a control portion 53 extended laterally. The drive portion 52 is coupled with the stress end 42 of the release valve lever 40, and the control portion 53 swings around the pivot point 51. As compared with a typical structure in the prior art, an actuating arm structure could be implemented through the control portion 53 of said lever-type control unit 50 and the designed swinging behavior, making it possible to save force more easily and operate it more conveniently by a single-hand.

Through the laterally extended control portion 53 of said lever-type control unit 50, when the dust-removing structure is assembled at different heights with the changing shape of a nailer, the operator is only required to replace the lever-type control unit 50 with different lengths of control portion 53 to obtain the optimum pressing location, thus greatly reducing the cost arising from replacement of the nailer and providing better applicability.

As the control portion 53 of the lever-type control unit 50 is provided with a protruding guide rod 55, the guide groove 24 is located opposite to the top cover 21 for insertion and limitation of the protruding end 56 of the guide rod 55. So, the control portion 53 of the lever-type control unit 50 provides better stability if it is pressed.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
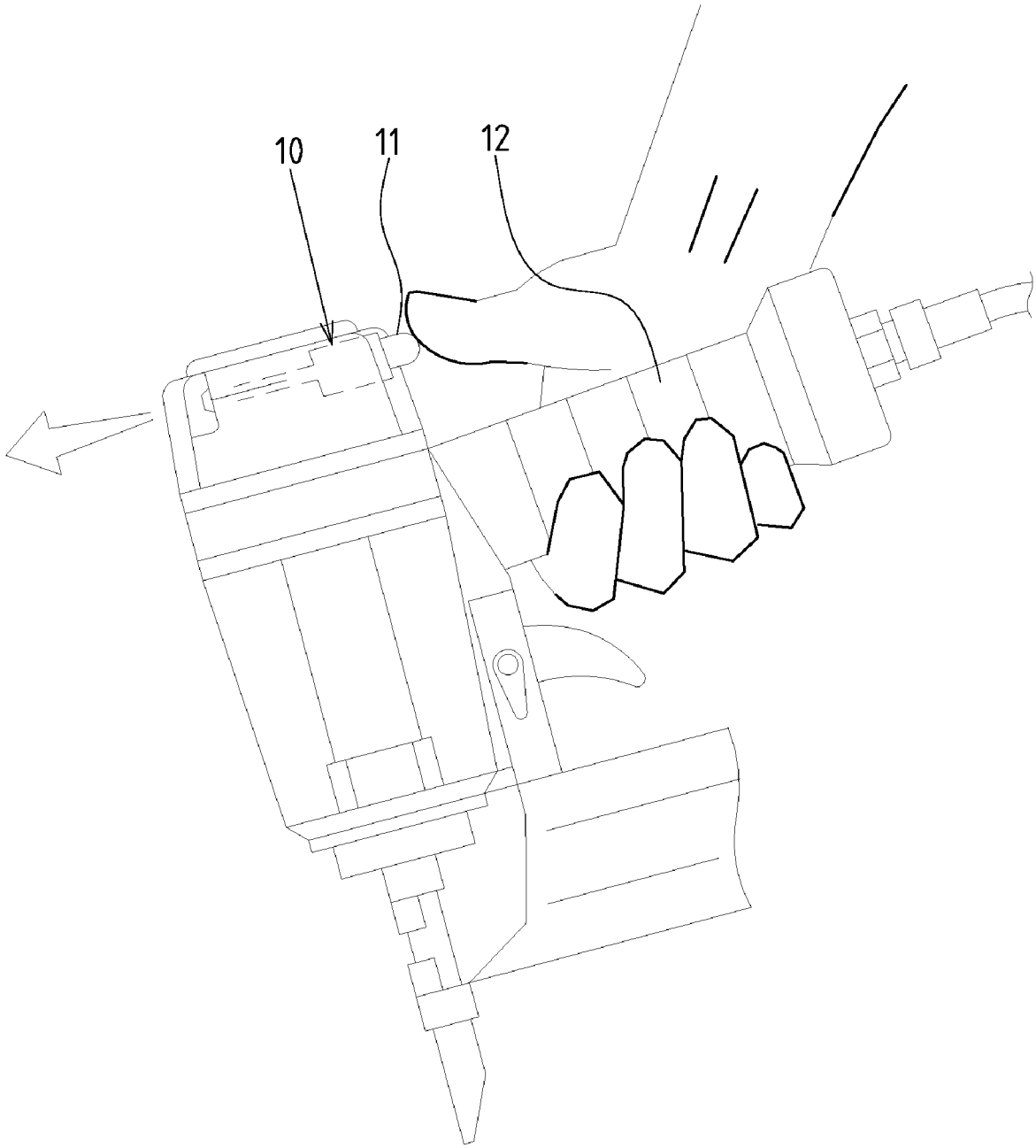
FIG.1 PRIOR ART
FIG. 1 shows a schematic view of the application of a prior art structure.
Figure 2:
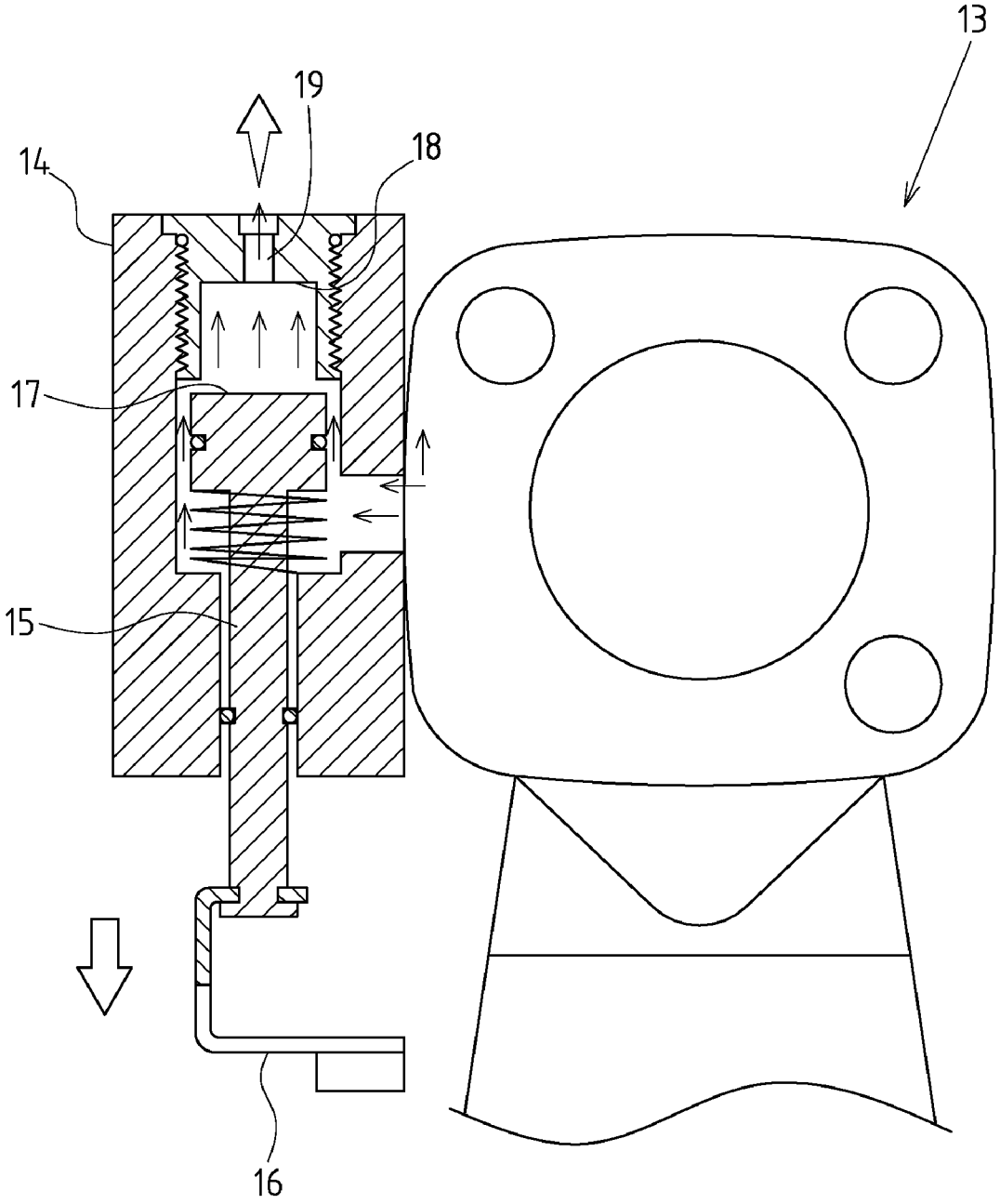
FIG.2 PRIOR ART
FIG. 2 shows a partial sectional view of a second prior art structure.
Figure 3:
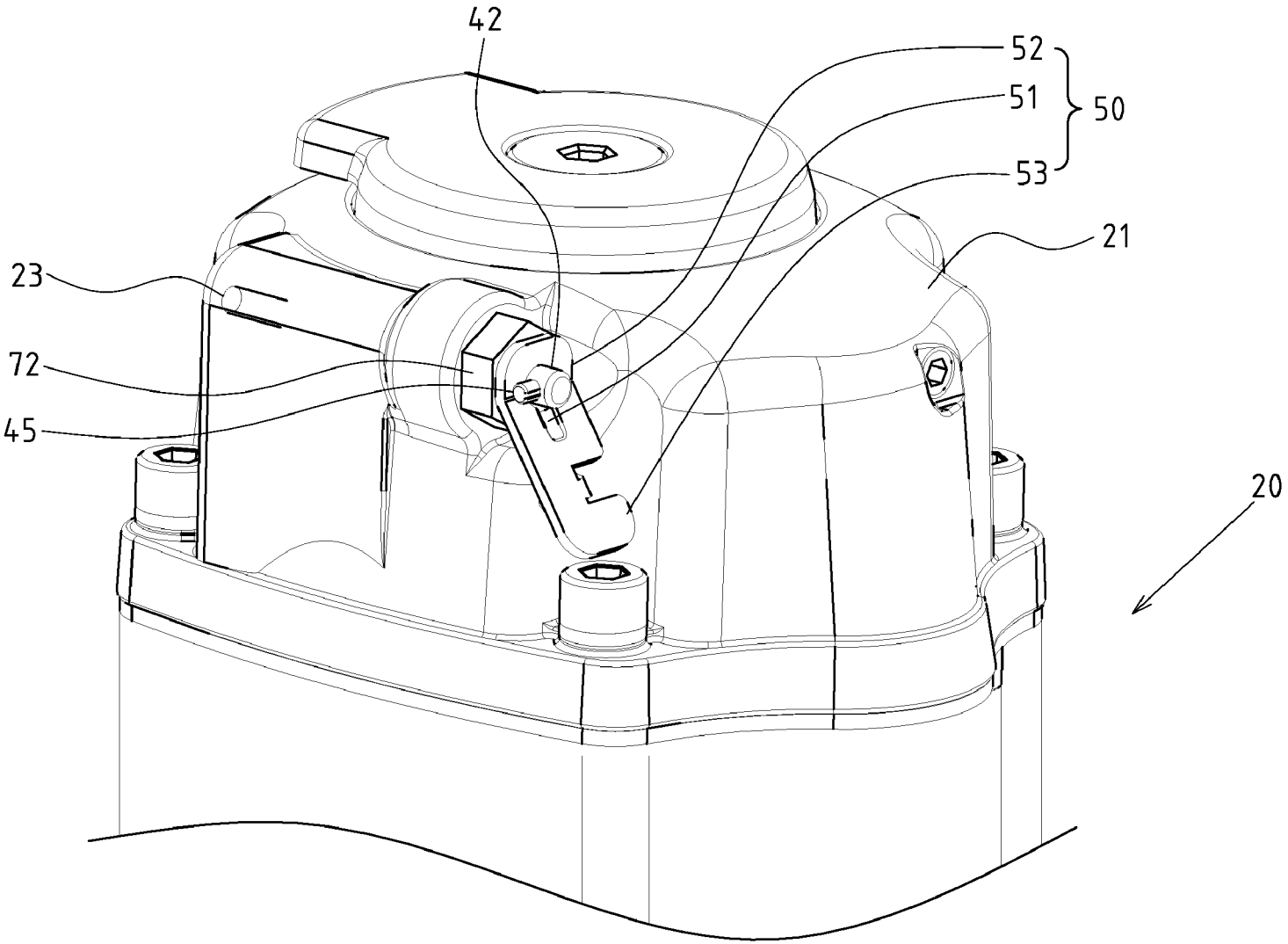
FIG. 3 shows an assembled perspective view of the preferred embodiment of the present invention.
Figure 4:
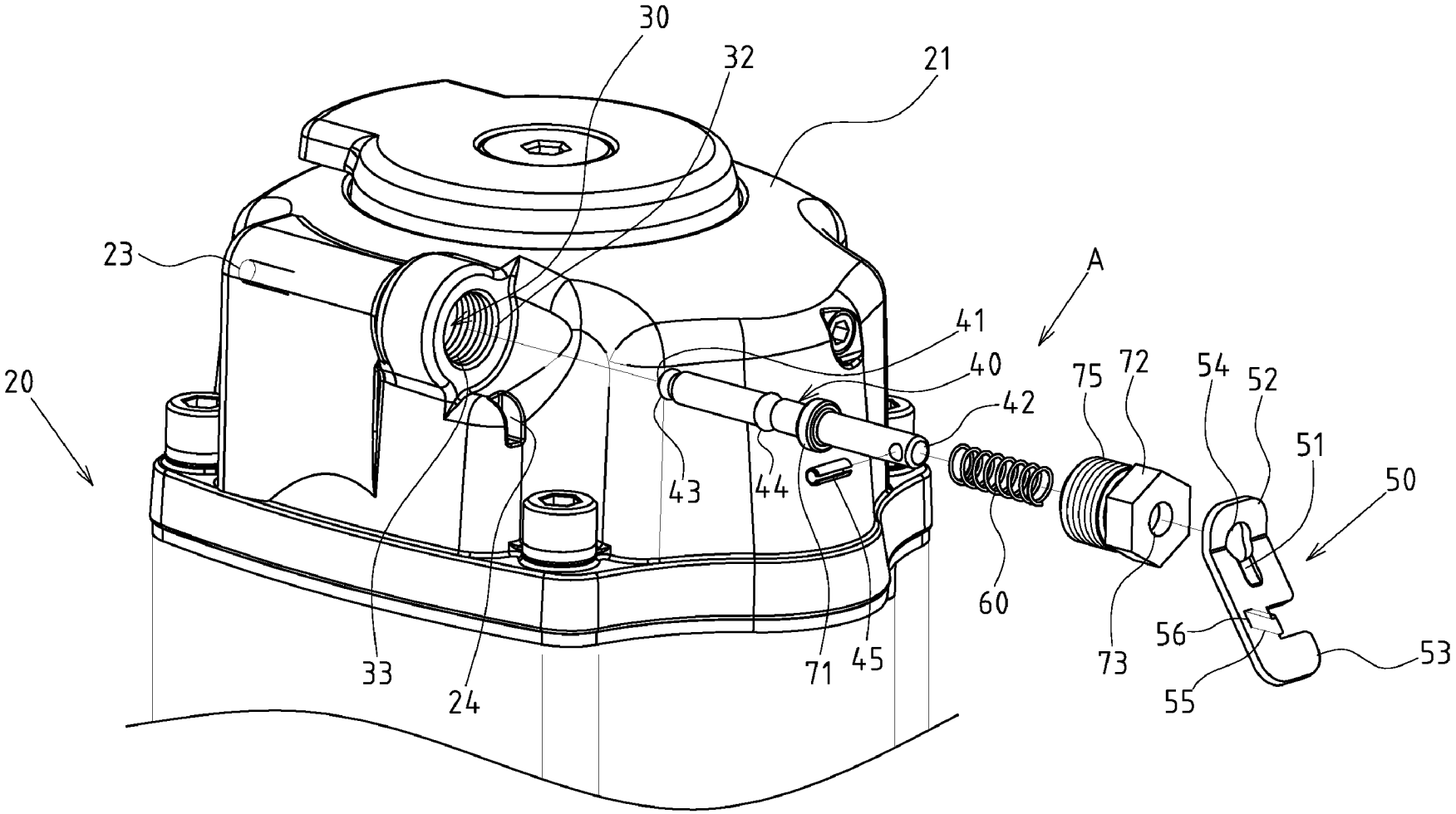
FIG. 4 shows an exploded perspective view of the preferred embodiment of the present invention.
Figure 5:
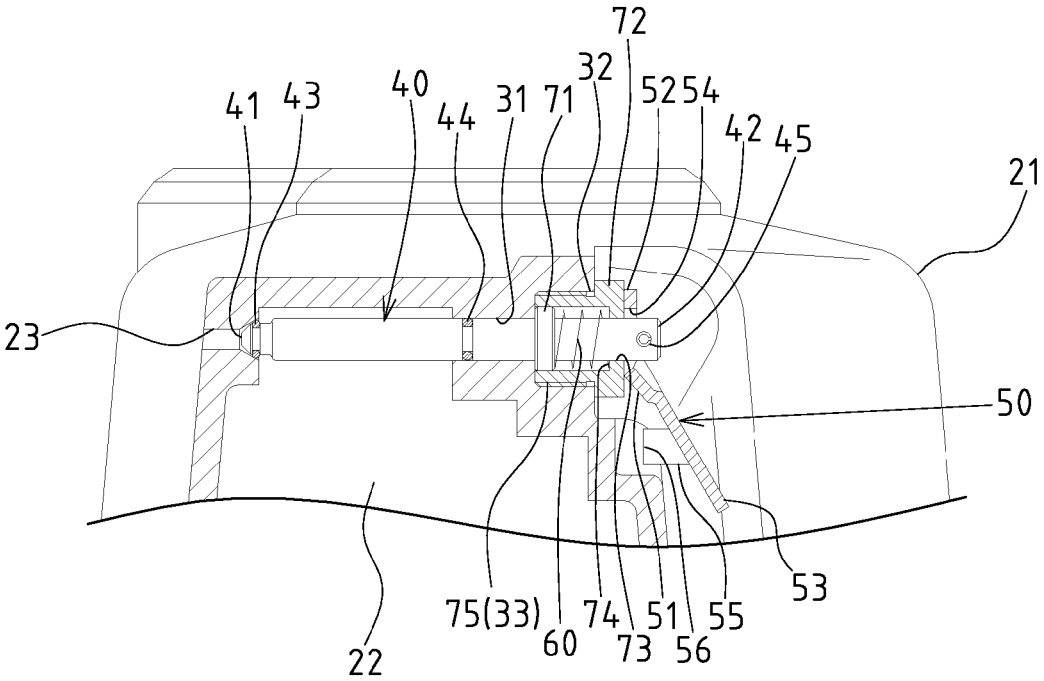
FIG. 5 shows an assembled sectional view of the preferred embodiment of the present invention, wherein the dust-removing structure is in a closed state.

FIGS. 3, 4 and 5 depict preferred embodiments of the improved dust-removing structure of a nailer of the present invention. The embodiments are provided only for explanatory purposes.

The dust-removing structure A is assembled onto the top cover 21 of the nailer 20 nearby a compressed air chamber 22

The dust-removing structure A comprises a jet hole 23, located at a preset position of the top cover 21 of the nailer 20. The inner end of the jet hole 23 is linked to the compressed air chamber 22 of the nailer 20.

A hold tank 30 is located on the top cover 21 of the nailer 20 axially to the jet hole 23. The hold tank 30 is internally provided with a through-hole 31 opposite to the jet hole 23, while an assembly port 32 is externally shaped onto the hold tank 30.

A release valve lever 40 has a braking end 41 and a stress end 42. The braking end 40 can pass the through-hole 31 of the hold tank 30, and then extend to the lockable jet hole 23. The stress end 42 of the release valve lever 40 can pass through the assembly port 32 of the hold tank 30, thus placing the release valve lever 40 in an axial slide state. The release valve lever 40 can be located securely through a spacing member. The braking end 41 of the release valve lever 40 and the middle section are separately provided with a ring seal 43, 44, thus enabling air-tightness of jet hole 23 and through-hole 31.

A lever-type control unit 50 is located externally onto the assembly port 32 of the hold tank 30, and designed into a long plate or post. The lever-type control unit 50 comprises a pivot point 51, a drive portion 52 and a laterally extended control portion 53. The drive portion 52 is coupled with the stress end 42 of the release valve lever 40, and the control portion 53 swings around the pivot point 51.

An elastic reset member 60, e.g. a spring, is assembled securely onto the hold tank 30, so that the axial slide of the release valve lever 40 could be reset.

The spacing member for the release valve lever 40 comprises a bulge ring 71 and a positioning cylinder 72. The bulge ring 71 is prefabricated onto the section of release valve lever 40 corresponding to the hold tank. So, the bulge ring 71 may shift synchronously with the release valve lever 40. The hollow positioning cylinder 72 is provided with a through-hole 73 for the release valve lever 40. A stop flange 74 is shaped within the through-hole 73 to block off the bulge ring 71. A threaded portion 75 is assembled externally onto the positioning cylinder 72, so that a screwed section 33 is set in the assembly port 32 of the hold tank 30 for screwing the threaded portion 75 of the positioning cylinder 72.

Referring to FIGS. 3-5, the pivot point 51 of the lever-type control unit 50 could be prefabricated onto the middle section of the lever-type control unit 50 (e.g. punch forming), and fastened at a fixed point. In this preferred embodiment, the pivot point 51 is adapted onto the external surface of said positioning cylinder 72. In addition, the drive portion 52 could be designed into a curved shape, and also provided with a through-hole 54 for the stress end 42 of the release valve lever 40. The stress end 42 allows a pin 45 for radial penetration, and the control portion 53 is extended laterally to a predefined length far away from the drive portion.

A guide rod 55 is located on the control portion 53 of the lever-type control unit 50, while the protruding end 56 of guide rod 55 is assembled towards the top cover 21 of the nailer 20, so that a guide groove 24 is located opposite to the top cover 21 for insertion and limitation of the protruding end 56 of the guide rod 55. With the guide rod 55 and guide groove 24, the control portion 53 of the lever-type control unit 50 provides better stability under a pressing state.

Based upon above-specified structures, the preferred embodiment of the present invention is operated as follows:

Referring to FIG. 5, when the control portion 53 of the lever-type control unit 50 is not pressed, and when the bulge ring 71 is pushed flexibly by the elastic reset member 60, the braking end 41 of the release valve lever 40 is stopped securely in the jet hole 23, making it impossible for the high-pressure air in the compressed air chamber 22 of nailer 20 to be blown out. On the other hand, the drive portion 52 of the lever-type control unit 50 is stopped onto the external surface of positioning cylinder 72 with the inward shift of release valve lever 40. The control portion 53 at the other end will tilt outwards due to the support of pivot point 51.

Figure 6:
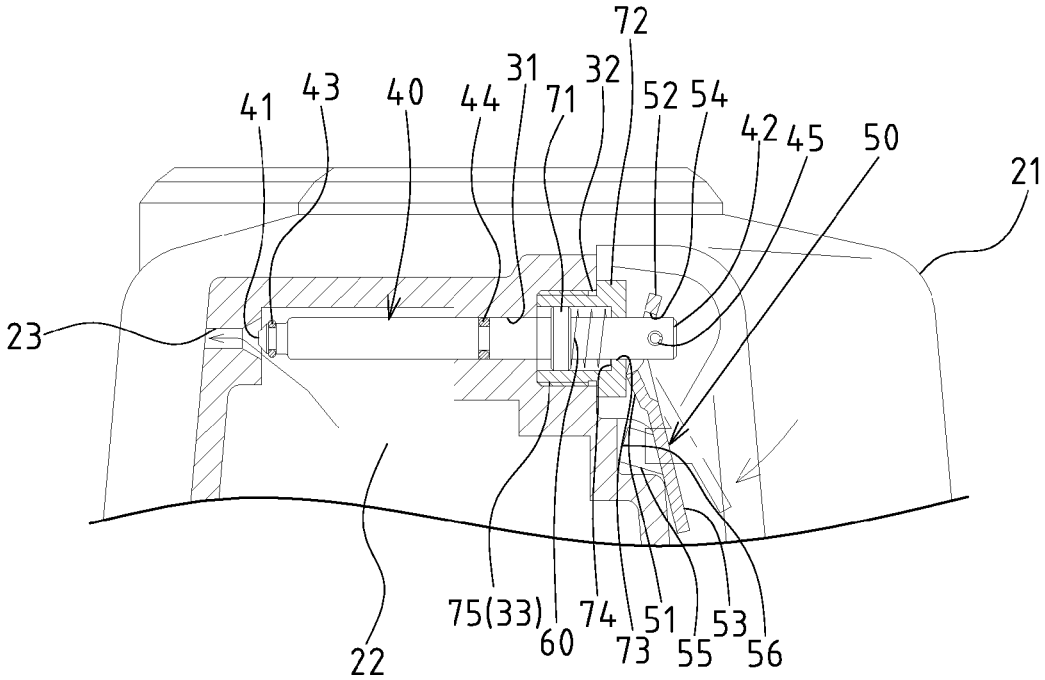
FIG. 6 shows a second assembled sectional view of the preferred embodiment of the present invention, wherein the dust-removing structure is in an opened state.

Referring also to FIG. 6, if it is intended to activate the dust-removing structure A, the control portion 53 of the lever-type control unit 50 is pressed. In such a case, the pivot point 51 enables the drive portion 52 to tilt outwards. Thus, through connection of the drive portion 52 and stress end 42, the release valve lever 40 may slide outwards, and the braking end 41 of the release valve lever 40 is disengaged from the jet hole 23, enabling the high-pressure air in the compressed air chamber 22 of nailer 20 to be blown out.

Figure 7:
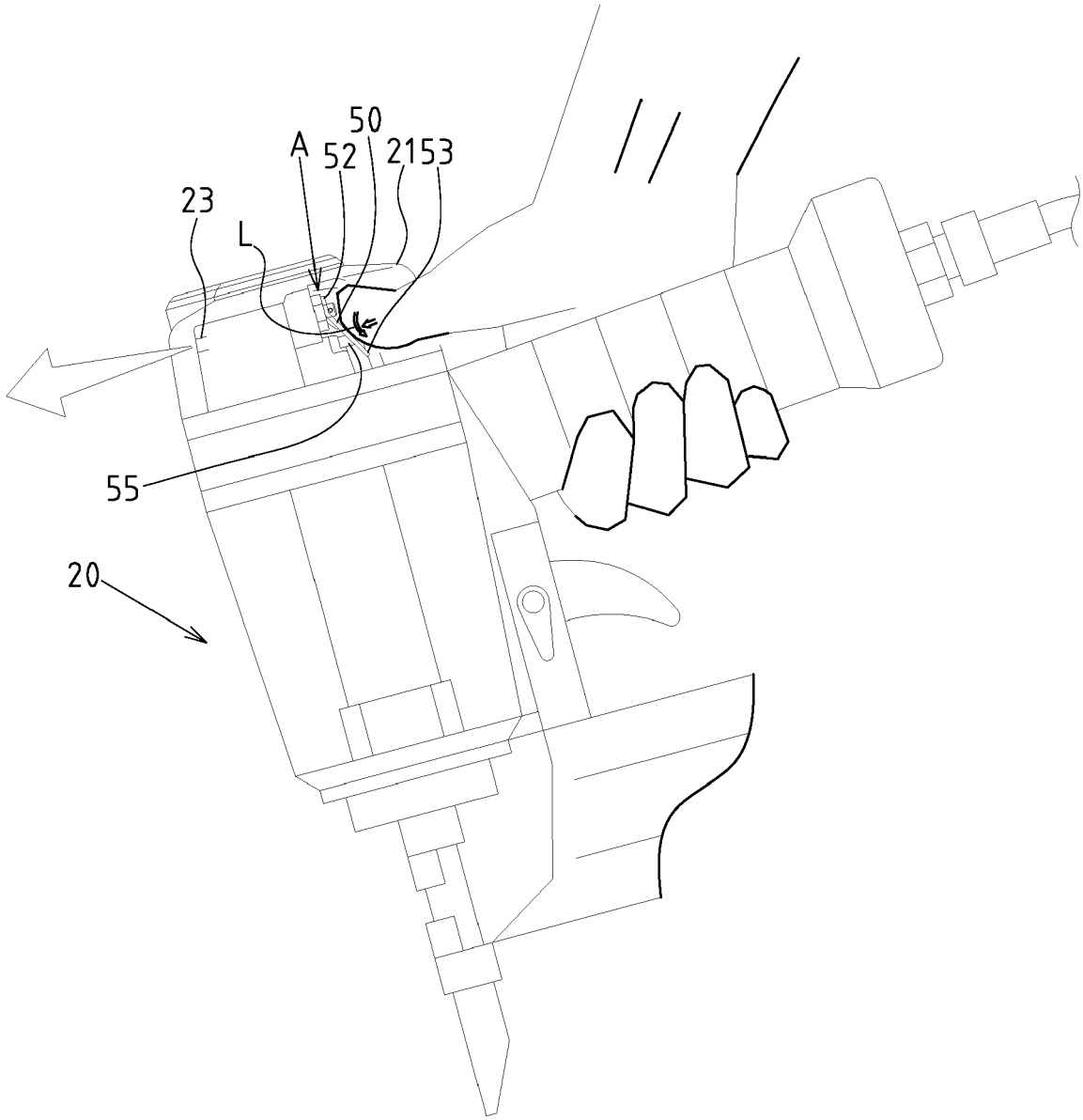
FIG. 7 shows a sectional view of the operation of the present invention.

Referring also to FIG. 7, the operator manually holds the handle of nailer 20 and presses the control portion 53 of the lever-type control unit 50 by thumb. Since the control portion 53 is extended laterally, the force applied from the thumb can be greatly reduced. In addition, the thumb may naturally apply a downward toggle force, as shown by arrow L in FIG. 7. This proves that, as compared with the prior art pushbutton structure, the control portion 53 of the present invention actually reduces the required force, serving the purpose of improving single-hand operation.

Figure 8:
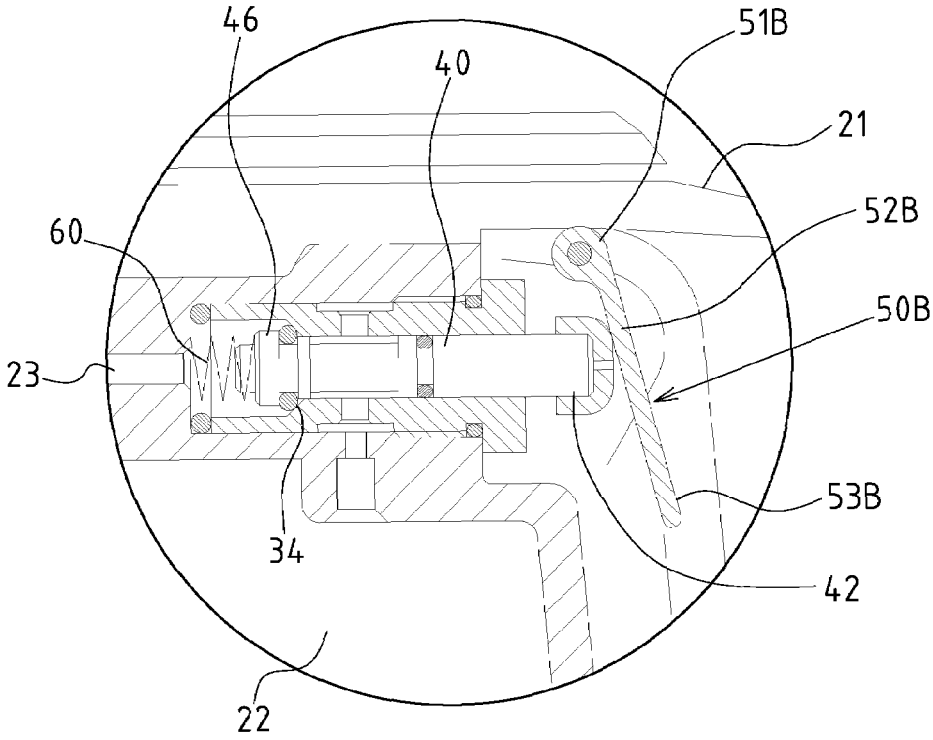
FIG. 8 shows another sectional view of the application of the lever-type control unit of the present invention.
Figure 9:
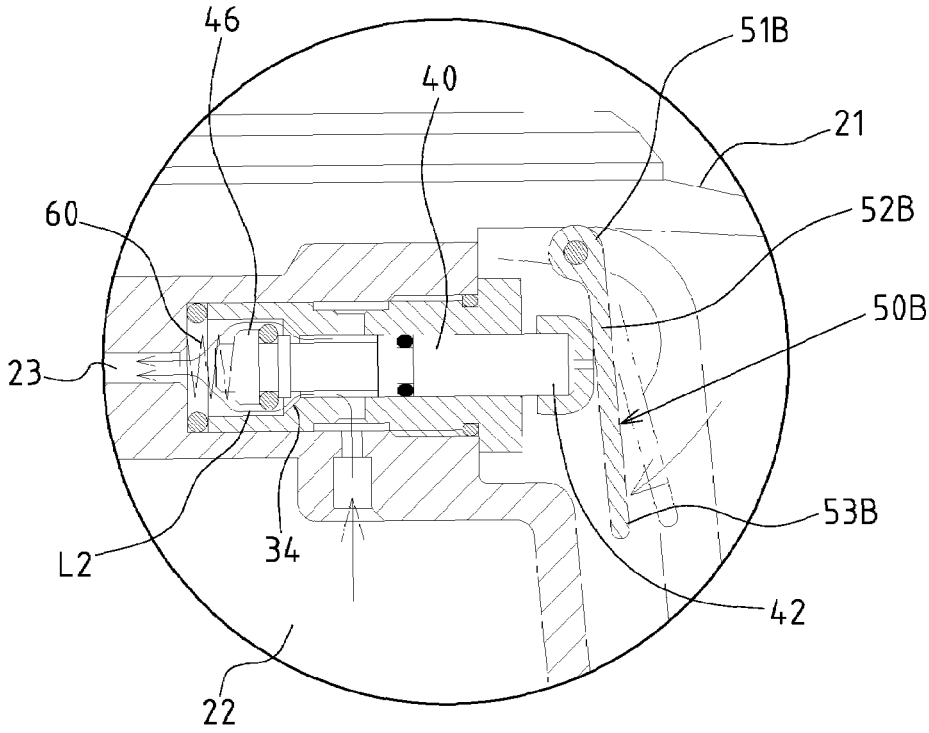
FIG. 9 shows a schematic view of the operation of the structure disclosed in FIG. 8.

Referring also to FIG. 8, the pivot point 51B and control portion 53B of the lever-type control unit 50B can be separately located at both ends of the lever-type control unit 50B. Thus, the pivot point 51B is assembled onto a fixed point of the nailer top cover 21, and the drive portion 52B is assembled onto the middle section of the lever-type control unit 50B. When the control portion 53B is pressed, as shown in FIG. 9, the drive portion 52B shifts inwards to drive the stress end 42 of the release valve lever 40. However, the internal structure of the release valve lever 40 differs from the aforementioned embodiment. For example, an expanded lever head 46 is shaped at the internal end of the release valve lever 40, so that the elastic reset member 60 is located between the expanded lever head 46 inner edge of the jet hole 23. Then, the expanded lever head 46 is normally supported and stopped at a circular shoulder 34, making it impossible for high-pressure air in the compressed air chamber 22 of nailer 20 to reach the jet hole 23. Otherwise, if the control portion 53B is pressed to drive the release valve lever 40 for internal shift, as shown in FIG. 9, the expanded lever head 46 can be disengaged from the circular shoulder 34, enabling the high-pressure air in the compressed air chamber 22 to reach the jet hole 23 through a predefined channel, as shown by arrow L2 in FIG. 9.

We claim:

1. A dust-removing apparatus comprising:

a nailer having a top cover, said nailer having a compressed air chamber adjacent said top cover;

a jet hole positioned in said top cover, said jet hole having an inner end linked to said compressed air chamber;

a hold tank located in said top cover and coaxial to said jet hole, said hold tank having a through hole extending opposite to said jet hole, said hold tank having an assembly port at an end of said through hole opposite said jet hole;

a release valve lever having a braking end and a stress end, said release valve lever extending through said through hole such that said braking end is cooperative with said jet hole, said stress end passing through said assembly port, said release valve lever being axially slidable in said through hole;

a spacing member affixed within said assembly port, said release valve lever extending securely through said spacing member, said release valve lever having a bulge ring extending circumferentially therearound, said spacing member formed by a positioning cylinder, said positioning cylinder having a stop flange formed interiorly thereof;

a lever assembly positioned externally of said assembly port, said lever assembly being a plate member having a pivot point and a drive portion and a laterally extended control portion, said drive portion being coupled to said stress end of said release valve lever, said control portion pivotally movable about said pivot point between a first position and a second position, said first position extending angularly outwardly of said top cover such that said bulge ring abuts a wall of said hold tank and said braking end of said release valve lever closes said jet hole, said second position being adjacent said top cover such that said bulge ring moves toward said stop flange of said positioning cylinder and such that said braking end of said release valve lever is away from said jet hole, said drive portion and said control portion of said lever assembly extending at an obtuse angle with respect to each other; and an elastic reset member received in said hold tank so as to urge said bulge ring against said wall of said hold tank.

2. The dust-removing apparatus of claim 1, said positioning cylinder being hollow and having a through hole through which said release valve lever extends, said positioning cylinder having a threaded portion engaged with said assembly port.

3. The dust-removing apparatus of claim 1, said pivot point of said lever assembly located centrally thereof and fastened at a fixed point, such drive portion having a curved shape and a hole, said hole of said drive portion receiving a stress end of said release valve lever therein, said stress end having a portion extending radially therethrough.

4. The dust-removing apparatus of claim 1, said pivot point of said lever assembly attached to a fixed point on said top cover.

5. The dust-removing apparatus of claim 1, said control portion of said lever assembly having a guide rod, said guide rod having a protruding end extending toward said top cover, said guide rod having a guide groove located opposite to said top cover for receiving said protruding end of said guide rod.

* * * * *